US008371199B2

(12) United States Patent
Ghimire

(10) Patent No.: US 8,371,199 B2
(45) Date of Patent: Feb. 12, 2013

(54) SMART FOOD CHOPPER

(76) Inventor: Shankar Raj Ghimire, Fairfax, VA (US)

( * ) Notice: Subject to any disclaimer, the term of this patent is extended or adjusted under 35 U.S.C. 154(b) by 806 days.

(21) Appl. No.: 12/386,873

(22) Filed: Apr. 26, 2009

(65) Prior Publication Data

US 2009/0277343 A1 Nov. 12, 2009

Related U.S. Application Data

(60) Provisional application No. 61/125,551, filed on Apr. 25, 2008.

(51) Int. Cl.
*B26D 1/06* (2006.01)

(52) U.S. Cl. ..... 83/751; 83/167; 83/618; 83/932

(58) Field of Classification Search ..... 83/751, 83/758, 786, 932, 167, 370, 74, 75, 76.7, 83/76.9, 697, 598, 599, 600, 618, 620, 623; 99/537–539

See application file for complete search history.

(56) References Cited

U.S. PATENT DOCUMENTS

| | | | | |
|---|---|---|---|---|
| 1,999,449 | A * | 4/1935 | Erickson | 83/751 |
| 2,327,018 | A * | 8/1943 | Criner | 83/751 |
| 3,463,211 | A * | 8/1969 | Holz | 83/404.3 |
| 3,614,970 | A * | 10/1971 | Webb | 83/408 |
| 4,051,757 | A * | 10/1977 | Reifenhauser et al. | 83/404.3 |
| 4,771,664 | A * | 9/1988 | Holz | 83/355 |
| 7,762,169 | B2 * | 7/2010 | Kaposi | 83/167 |

* cited by examiner

*Primary Examiner* — Stephen Choi

(57) ABSTRACT

A smart food chopping or slicing device comprising at least two moveable blade sets arranged in a grid like configuration wherein the blade sets are configured orthogonally such that the cutting edges of both the blade sets remain substantially in the same plane. The movement of one set of blades is independent of the movement of another set of blades and can be independently controlled. The moveable blade sets are configured for lateral reciprocal movement. The plane of the lateral reciprocal movement of the cutting edges of the blade sets and the plane of the cutting edges of the blade sets are substantially the same or the same parallel planes. The blade sets are removeably mounted on a means capable of providing lateral reciprocal movement to the blade sets.

25 Claims, 20 Drawing Sheets

(top view of the device showing different components of the system according to an embodiment of the invention. The sensor is not shown).

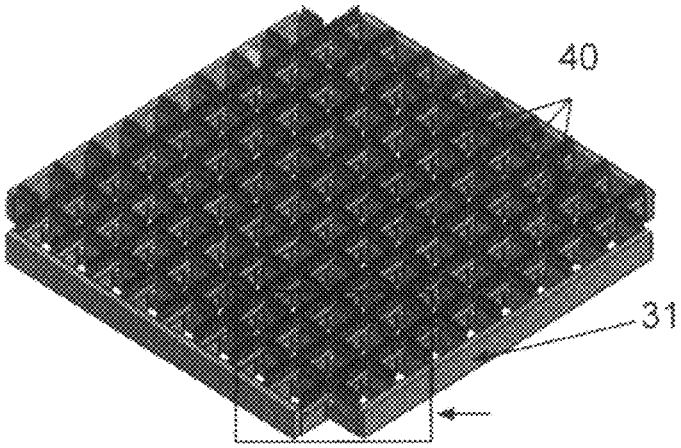
Figure. 3 (Orthogonally configured moveable blade sets according to an embodiment of the present invention)

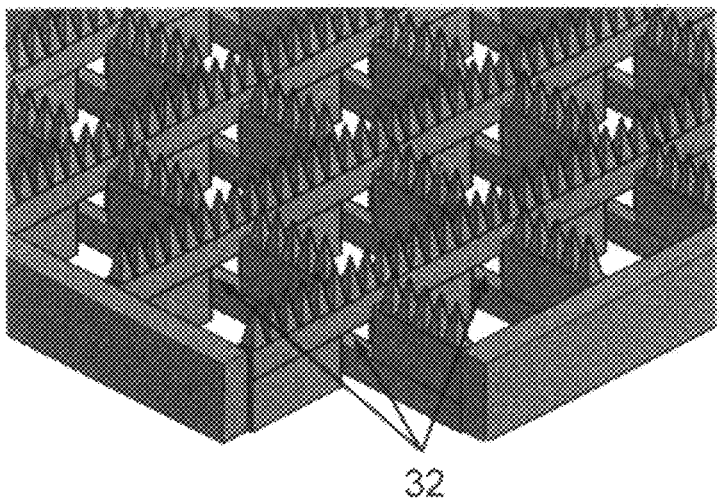
Figure. 4 (Blown up picture of box region shown by bold arrow ( ⟶ ) in figure 3)

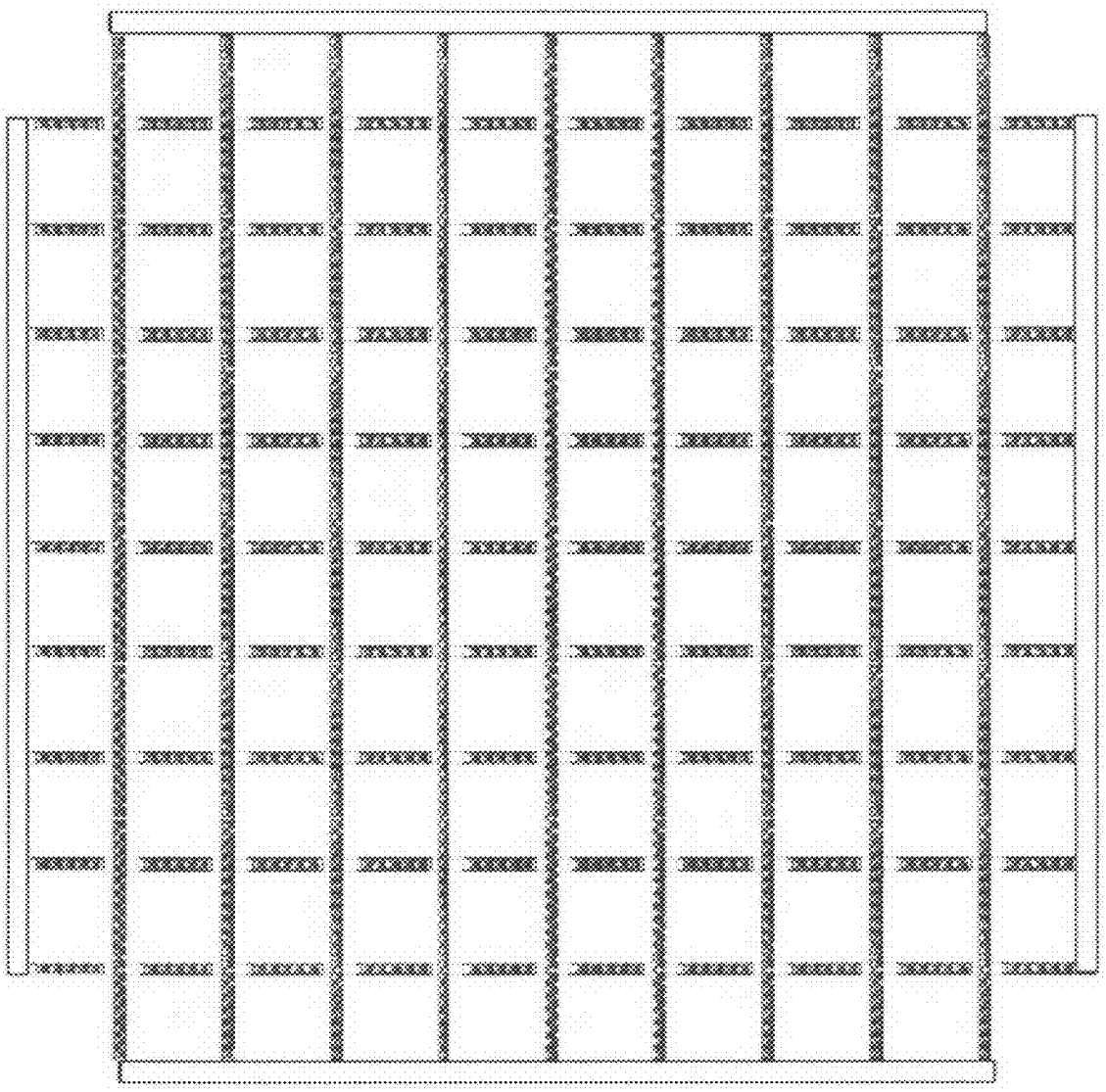
Figure 5 (Top view of figure 3)

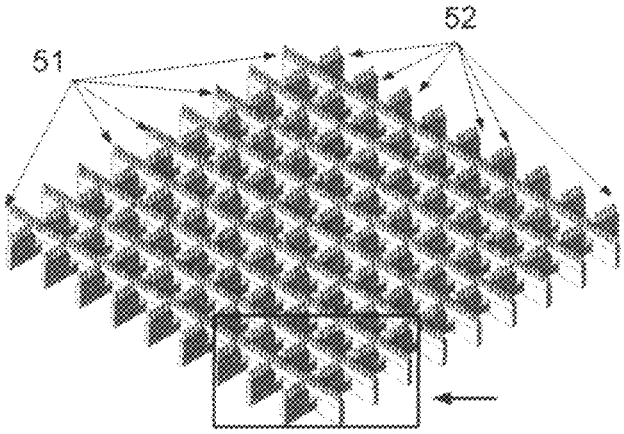
Figure 6 (Moveable parallel blade sets 51, and 52 configured orthogonally in a plane according to an embodiment of the present invention. The supporting side frames are not shown)

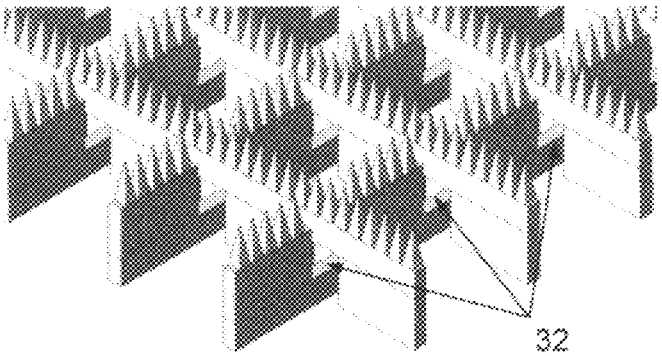
Figure. 7 (Blown up picture of the box region shown by bold arrow ( ⟶ ) in figure 6)
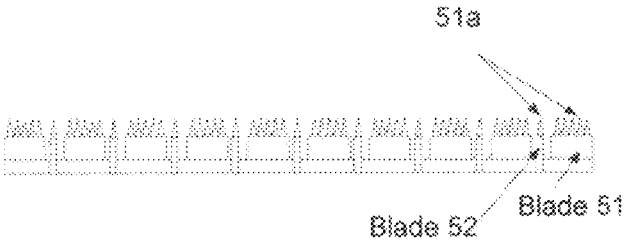
Figure 8 (Side view of moveable parallel blade sets 51, and 52 configured orthogonally in a plane. The supporting side frames are not shown)

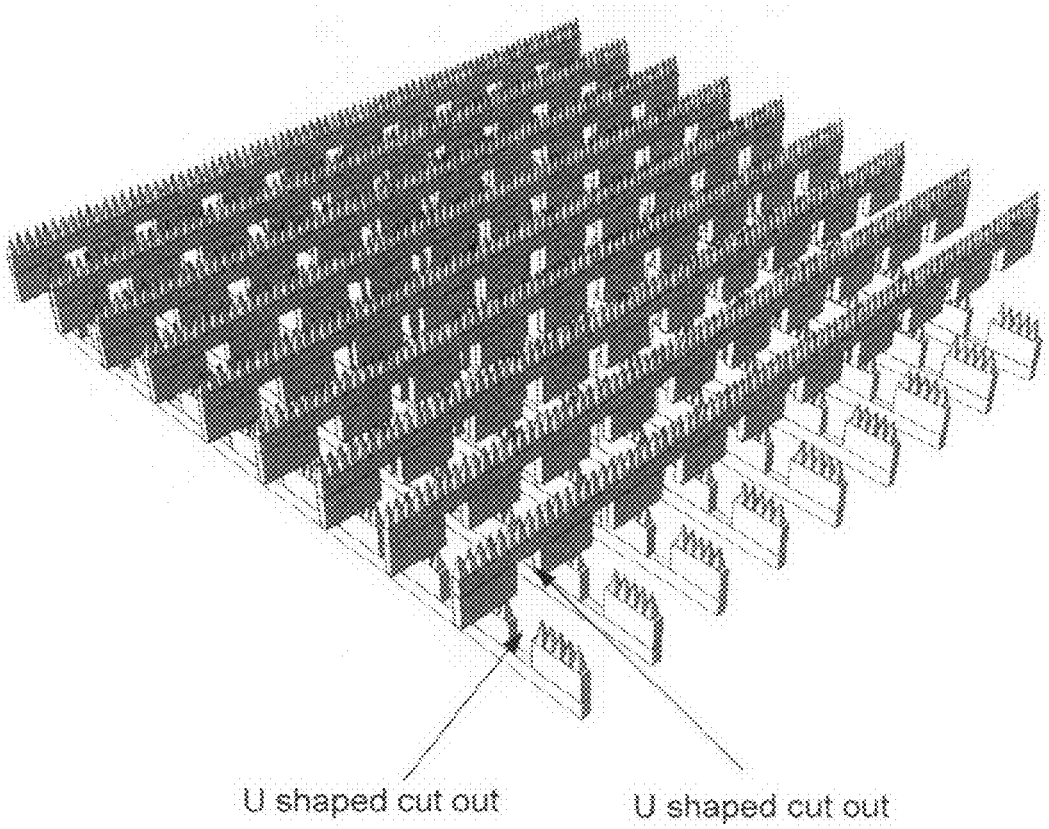
Figure 9. (Isometric view of the blade sets 51, and 52 wherein the blade sets 51, and 52 are vertically separated apart.)

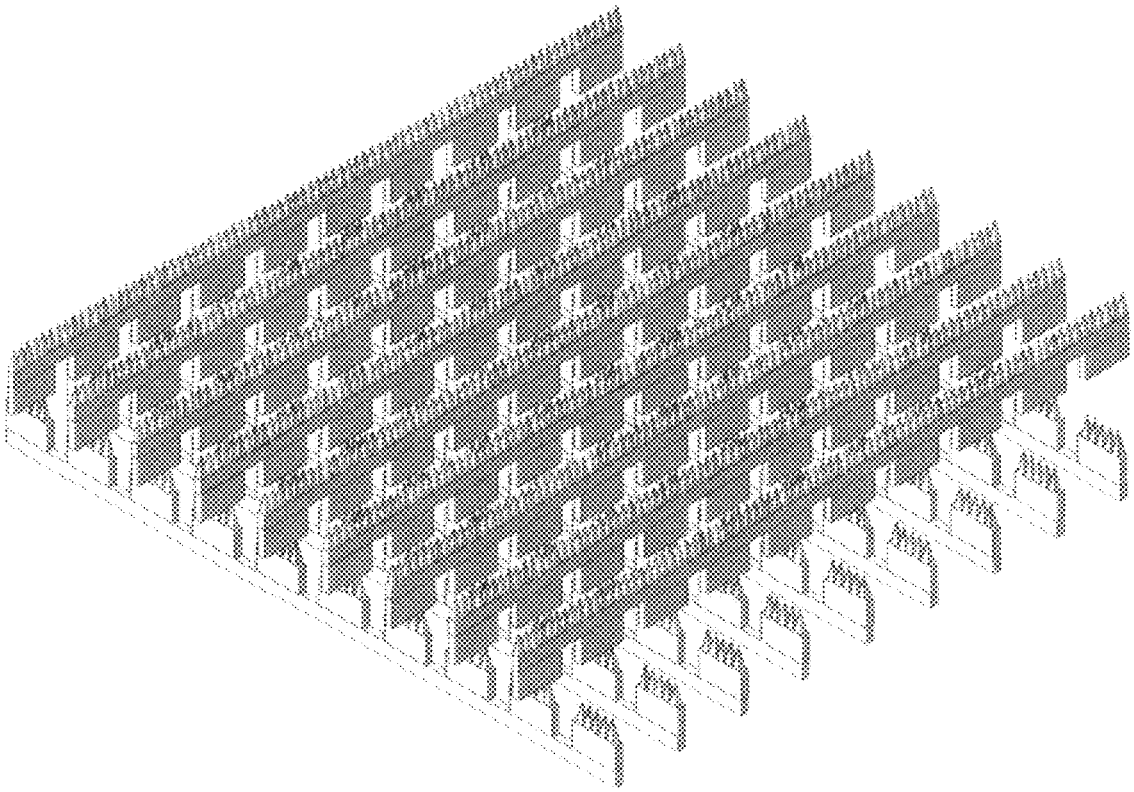
Figure 10. (Different isometric view of the blade sets 51, and 52 wherein the blade sets 51, and 52 are vertically separated apart)

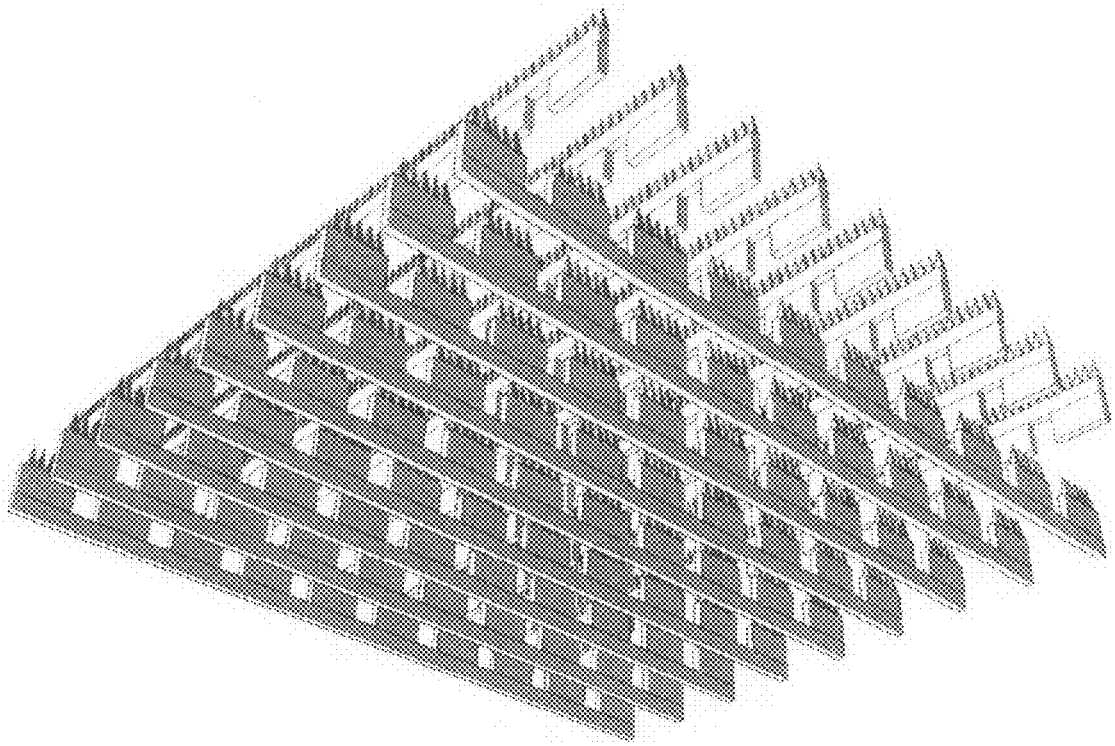
Figure 11. (Another different isometric view (front bottom right view) with blade sets vertically separated apart for the purpose of teaching. The figure shows how the cut outs in the blades allow for the orthogonal arrangement/configuration of the blade sets)

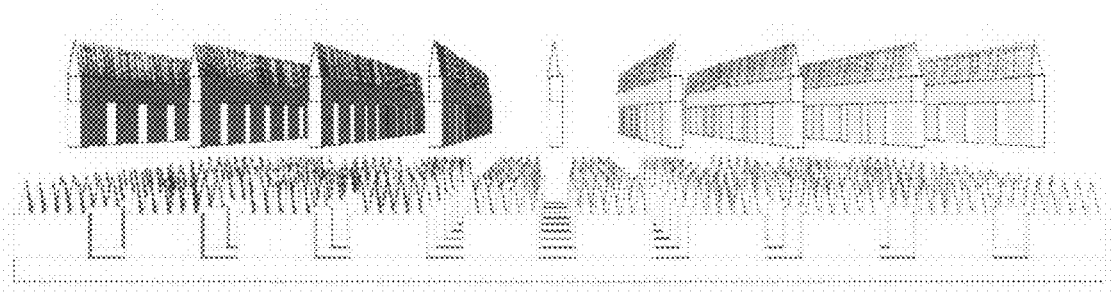
Figure 12 (Front view with the blade sets vertically separated apart for the purpose of teaching)
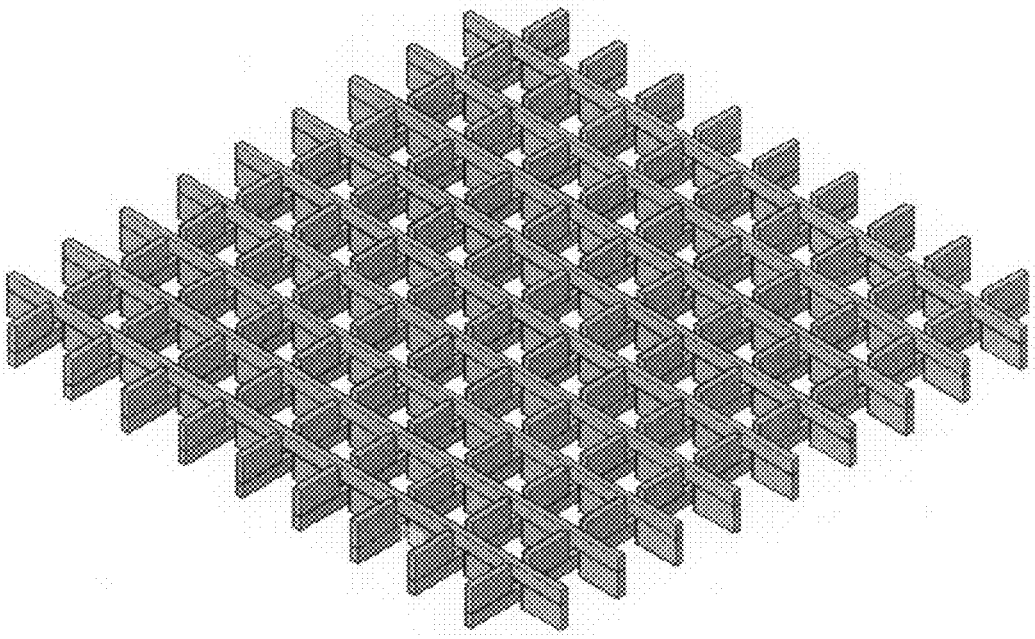
Figure 13 (Another blade sets 53, and 54 without saw at the cutting edge, configured orthogonally in a plane according to an embodiment of the present invention. The supporting sides have been removed for the clarity of the picture)

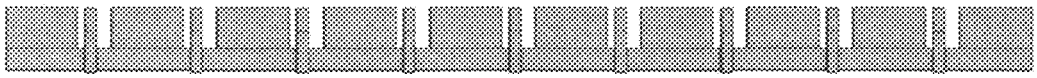
Figure 14 (Side view of orthogonally configured blade sets 53 or 54 without the saw at the cutting edge)
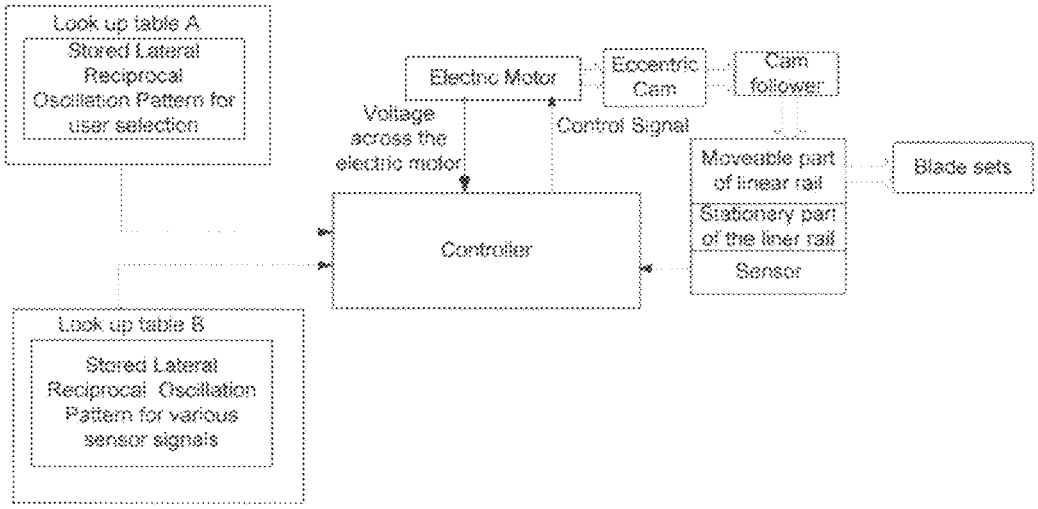
Figure 15 (Showing different components of the system and their connections of the present invention)

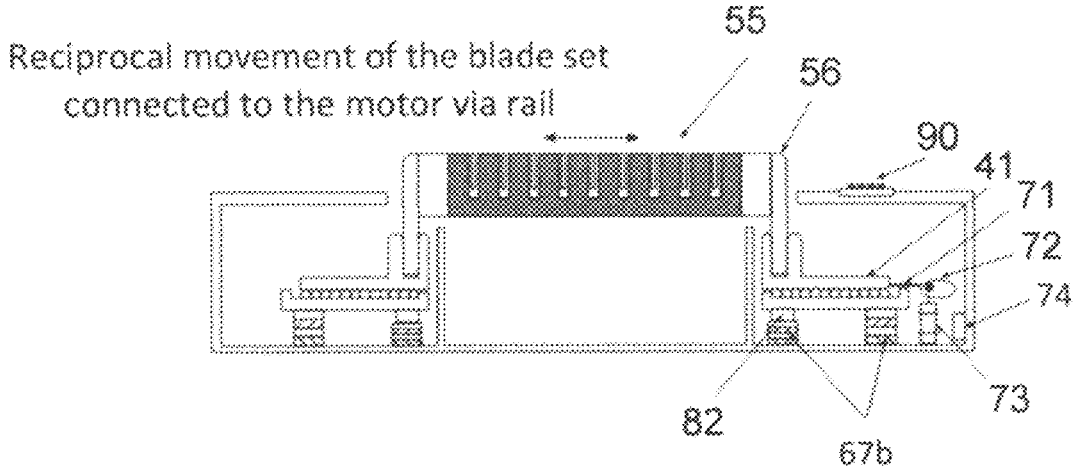
Figure 16 (side view showing different components of the present invention)

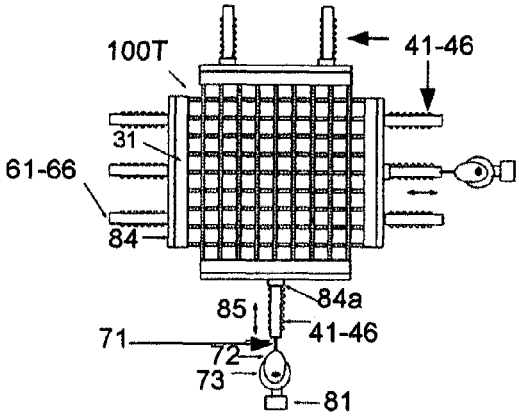
Figure 17 (top view of the device showing different components of the system according to an embodiment of the invention. The sensor is not shown).

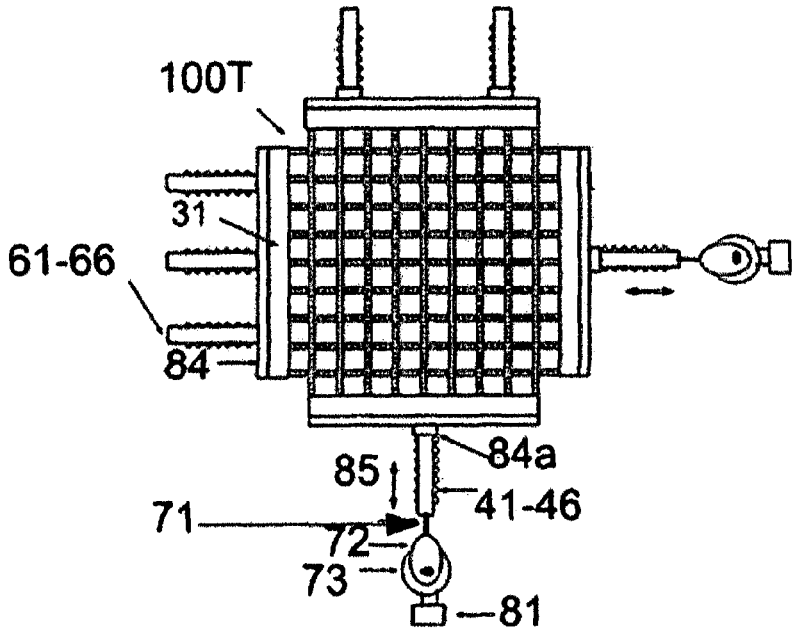
Figure 18 (top view showing different components of the system according to a preferred embodiment of the system. The sensor is not shown).

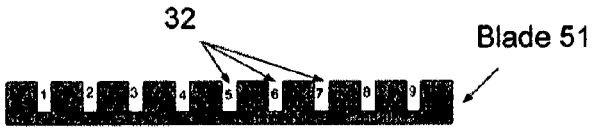
Figure 19a (Side view of one embodiment of the blade. The Saw at the top of the blade is not shown)
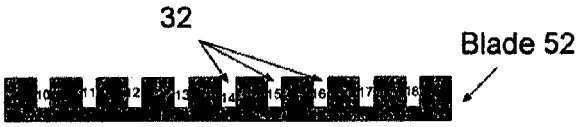
Figure 19b (Side view of one embodiment of blade. The saw at the top of the blade is not shown)

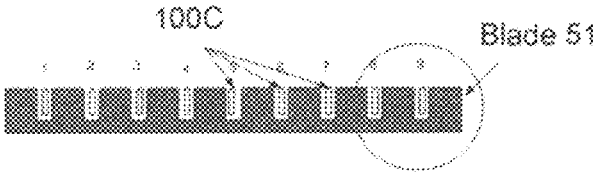
Figure 19c Cross section through a blade along its axis when the blade sets are orthogonally configured. The saw at the top of the blades is not shown.
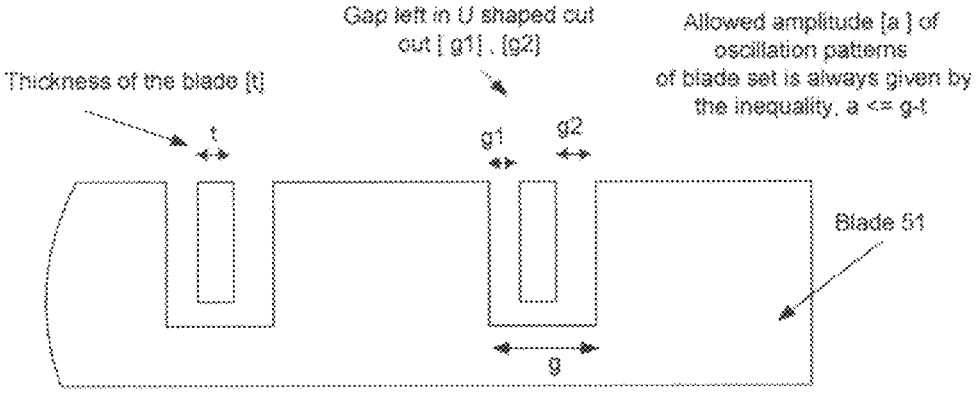
Figure 20 showing blown up picture of the circle region of figure 19c. This picture shows allowable amplitude of oscillation of the blade sets

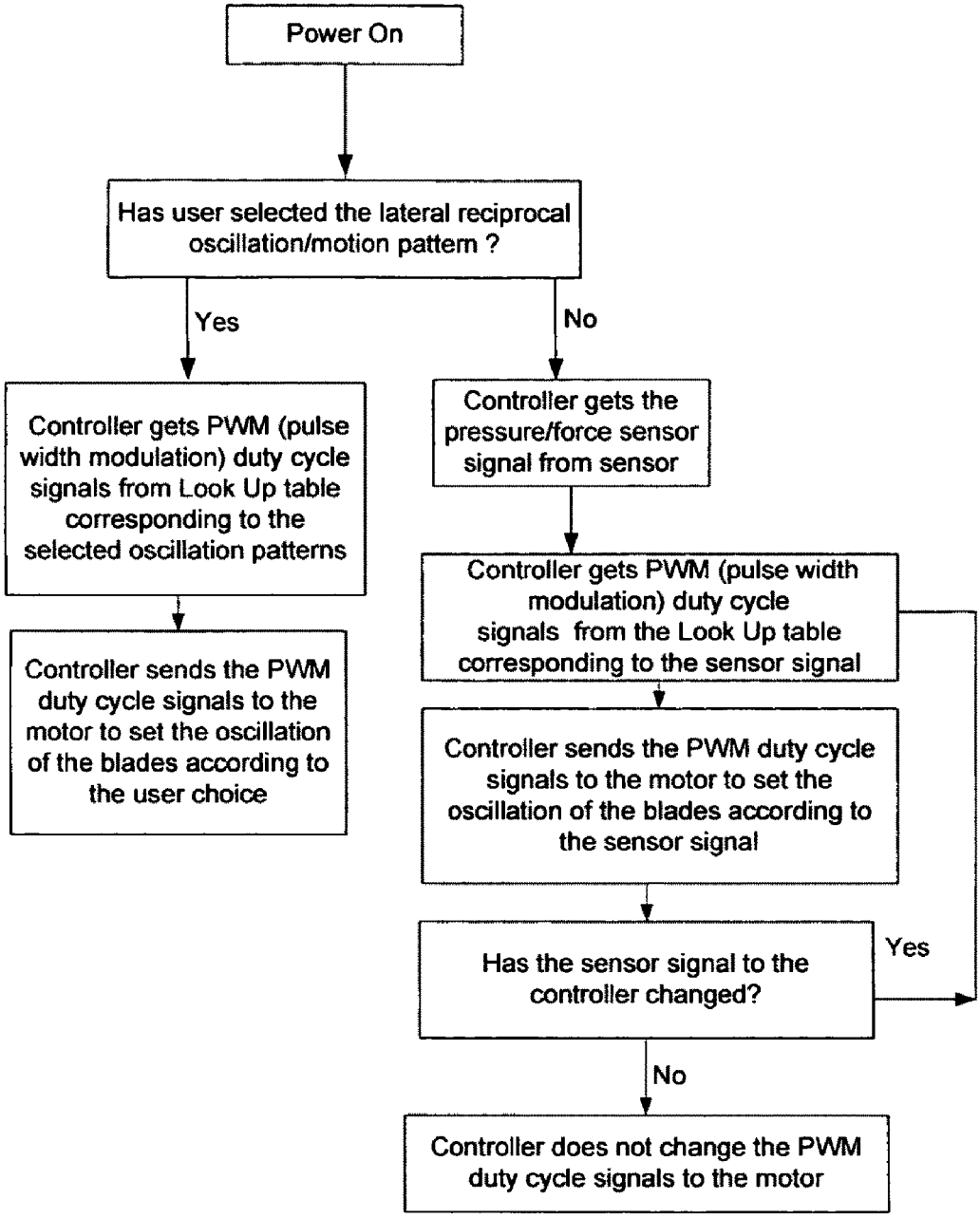
Figure 21 (Several steps describing how the invented system/device works)

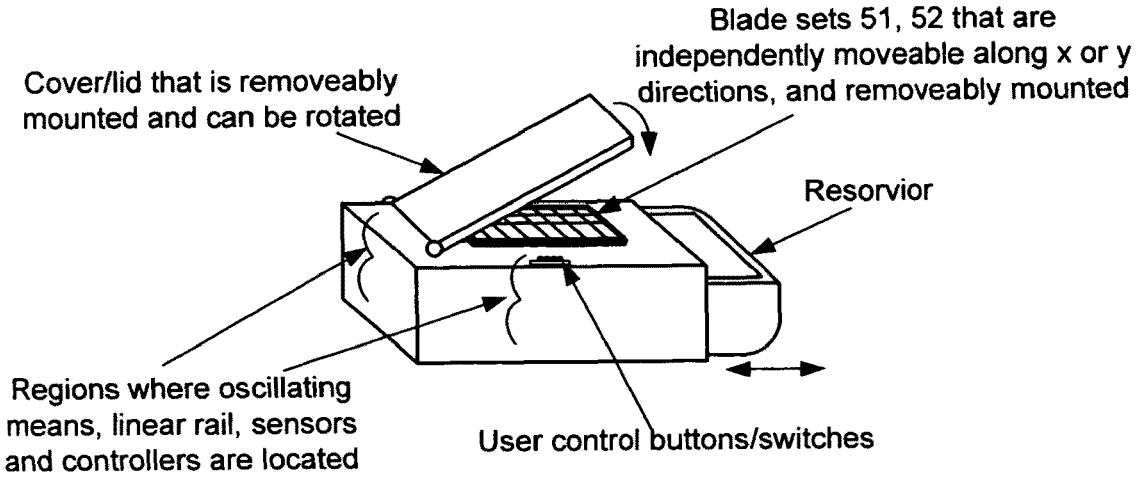
Figure 22 (Schematic of a smart food chopper according to an embodiment of the invention)

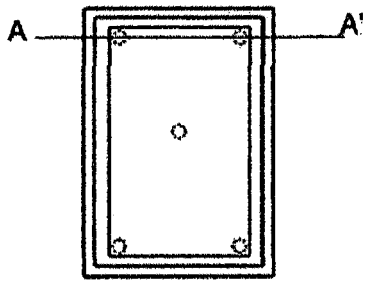
Figure 23A showing the location of spring and sensor mechanism. The sensor and spring mechanism are located at the four corner of the lid and at the center as indicated by circles.
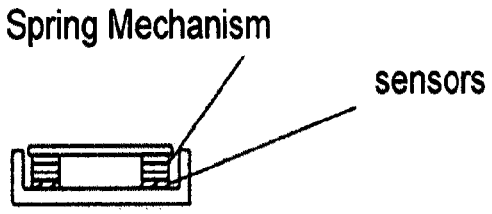
Figure 23B showing the cross-section along the line AA' of figure 23A

SMART FOOD CHOPPER

CROSS REFERENCE TO RELATED APPLICATIONS

This application claims priority under 35 USC 119(e) (1) of U.S. Provisional Patent Application Ser. No. 61/125,551 filed on Apr. 25, 2008.

FIELD OF THE INVENTION

This invention relates generally to food preparation devices, including devices for chopping or slicing onions, tomatoes, potatoes, mushroom, carrots, and the like.

BACKGROUND OF THE INVENTION

In preparing food it is often required to slice vegetables such as onion, potato, or tomato into small pieces. Most commonly, this is done by using knife. There are other specially designed devices for chopping foods, but none is particularly well suited for chopping onion, tomato etc. in an easy and efficient manner.

One exemplary and specially designed device for chopping onions, potato, tomato etc. includes an array of rectangular projections that can be pressed downward to push the food and vegetables through a grid of blades (see U.S. patent application publication 2007/0125210 A1). In this device, the blades are always immoveable. This device can not slice the vegetables with stiff skin or outer layer, or the vegetables that are too soft or hard, in an efficient manner. In such devices, during the process of chopping, outer stiffer layer gets stuck on the grid and vegetables can not be chopped completely. With the soft vegetables such as tomatoes, the vegetables get squashed during the process of chopping. There is, therefore, a need for an improved food or vegetable chopping or slicing device that can work for all kinds of foods, fruits and vegetables.

SUMMARY OF THE INVENTION

It is an objective of the invention to provide blade sets that are orthogonally configured and are capable moving/oscillating in a lateral reciprocal direction. The individual blades in each blade sets are substantially parallel. Each set of parallel blades are supported on both sides by two supporting frames. The cutting edges of the both sets of blades lie substantially in the same plane. Rectangular cut outs are provided in each blade in periodic manner such that one set of blade can be configured orthogonally to another set of blade by bringing the cut out portions close to one another. The cut outs also allow for the cutting edges of each set of blades lying in the same plane. The network of blades thus formed provides reciprocally moveable blades configured at right angles with generally squared openings. In two blade sets, one set of blade is capable to move reciprocally along x-axis and other set of blade is capable to move reciprocally along y-axis and both the motion can be independent of one another.

The supporting frame of the blade sets have extensions which are designed to a snap fit to a linearly moveable part of a linear rail. The linearly moveable part of the linear rail is connected to a means (e.g. an electric motor that rotates an eccentric cam to produce a linear reciprocal motion) that can provide a linearly reciprocating motion/action to the moveable blades.

A lid is provided which is hinged on the top surface at one end of the housing such that it can be pressed downward toward the blade sets pressing the food through the opening formed by the orthogonally configured sets. In a referred embodiment, a force or pressure sensor is provided underneath the linear rail to detect the pressure exerted on the blades sets during the process of food/vegetable chopping.

A controller is provided to control the reciprocal action of the blade sets according to users' selection, or according to signal from the sensor. According to an embodiment, the controller receives the force or pressure signal from the sensor and uses a look up table to get the corresponding pulse width modulation signal (PWM). The controller sends the corresponding PWM signal to the electric motor to adjust the speed of the motor and thus to adjust the linear reciprocal oscillation of the blade sets according to the pressure exerted on the blades so that smooth and fast chopping of the food can be done. The controller continues to send the same PWM signal to the electric motor unless the pressure sensor signal changes in which case the controller sends the adjusted PWM signal to the motor to change the speed of the motor and thus to change the reciprocating motion/action of the blade sets according to the new pressure/force signal. In this way, the controller is capable of changing the reciprocal oscillation/motion according to the pressure exerted on the blade sets by the food being chopped to provide a smooth and controlled chopping of the food.

In a preferred embodiment, the sensor is a piezoelectric, or a capacitive, or any other pressure sensor that is capable of sensing the pressure exerted on the blade sets.

In another embodiment, the sensor may be positioned at any other locations such as on the surface of the lid that faces the blade sets.

In another preferred embodiment, a user setting arrangement is provided wherein a user is allowed to select a reciprocating motion/action pattern of the blades. Several reciprocating oscillation patterns can be saved in the look up table in the form of PWM signal. When a user selects a particular pattern of the reciprocating motion, the corresponding PWM signal is sent to the motor by the controller to produce user selected oscillation patterns.

In another embodiment, the user is allowed to select whether he/she wants to produce reciprocal motion on both sets of blades or one set of blades only.

In yet another embodiment, a voltage sensor is provided to sense the predetermined limit of the voltage across the motor. If the predetermined value of the voltage is reached, the controller sends a signal to shut the motor down to by cutting off the current so that equipment can be saved from being damaged.

When the food is completely chopped off or processed, the pressure on the blade sets decreases to a minimum level which will be sensed by the sensor, and corresponding signal is sent to the controller. In an embodiment, the controller automatically turns off the motor when the pressure sensor signal is under a predetermined lower limit.

In another preferred embodiment, three linear rails are provided for each blade sets for providing support and linear reciprocal motion/action/oscillation. In the preferred embodiment, the three linear rails are configured in a triangular position. Two linear rails are configured in one side of the frame and the third on the other side of the frame. All the three linear rails can snap fit to a snap fitting means of the support frame of the blade and are moveable along the axial direction of the blade sets. The electric motor provides reciprocating action via the third linear rail in the following way. The shaft of the electric motor is connected to an eccentric cam which converts rotational motion into a linear motion. A cam follower is connected between the eccentric cam and one end of the moveable part of the linear rail. Thus a linear reciprocal motion is coupled to the moveable part of the linear rail. The blade sets are connected to the moveable part of the linear rail. The linear rails not only help transferring the linear reciprocal motion to the blade sets, but also provide the reciprocal motion substantially along the axial line of the blade sets. The linear rails also provide support to the blade sets. The triangular configuration of the motor and the rail provide a smooth coupling of the reciprocal motion to the blades sets. The triangular configuration also provides an easy vertical and planar adjustment of the blade sets when needed. Another set of blades is also provided similar arrangement of the blade sets.

In another embodiment, four linear rails are configured in rectangular positions for each blade sets, and electric motor and fifth linear rail are arranged in one side of the support frame and are substantially positioned at the centre of the frame.

In another embodiment, six linear rails and one motor are coupled to each blade sets wherein four linear rails are connected at four corners, two linear rails are connected substantially at the center of the support frame on both sides, and the electric motor is coupled to one of the rail connected at the center.

In a preferred embodiment, housing is provided for the linear rails, electric motors, and sensors. The blade sets can be removeably mounted on the linear rails externally. In one embodiment, the blade sets snap fit to the linear rail so that they can be removed, washed or cleaned and snap fitted back to the rails of the housing. A slideable container is provided which can be slide in the space just under the orthogonal blades sets and can be used to collect the processed food. The slidable container may be removable.

A lid is provided which is hinged one the top and one end of the housing such that it can be pressed downward toward the blade sets pressing food through the opening. Optionally, small projections that extend downward can be provided on the surface of the lid that faces the blades. The projections can help the food pass through the rectangular opening of the blade sets as the lid is pressed to process the food through the blade sets. The projections on the lid are sized and located within the lid such that when the lid is closed a projection fits within each of the blade openings.

TABLE 1

| Reference sign(s) | Representation/description for reference sign(s) |
|---|---|
| 31 | Supporting frame |
| 32 | U-shaped cut outs/Rectangular cut outs |
| 40 | Saw blades |
| 51 | Saw blade set, moveable along x-axis |
| 52 | Saw blade set, moveable along y-axis |
| 51a | Saw |
| Blade 51 | One of the blades of the blade set 51 |
| Blade 52 | One of the blades of the blade set 52 |
| 53 | Another blade set without saw at the cutting edge, moveable along x-axis |
| 54 | Another blade set without saw at the cutting edge, moveable along y-axis |
| 55 | Cross-section through the center of a blade along the axial line, when both the blade sets are orthogonally configured |
| 56 | Snap fit mechanism connected to the blade set |
| 90 | User control setting |
| 41-46 | Moveable part of linear rail |
| 61-66 | linear rail |
| 67a | Spring mechanism |
| 82a | Pressure/force sensor |
| 83 | Supporting frame |

TABLE 1-continued

| Reference sign(s) | Representation/description for reference sign(s) |
|---|---|
| 84 | Snap fit mechanism connected to the blade set |
| 85 | Reciprocal movement of linear rail |
| 71 | Cam follower |
| 72 | Eccentric cam |
| 74 | Controller and Look up table |
| 73 | Electric Motor |
| 81 | Controller |
| 84a | Snap fit mechanism |
| 41-46 | Moveable part of linear rail |
| 32 | Rectangular cut outs |
| 100C | Cross section of blade sets which are orthogonal to blade 51 |
| 100T | Top view of orthogonally configured blade sets 51, 52 |
| t | Thickness of the blade |
| g1 | $Gap_1$ left in U shaped cut out |
| g2 | $Gap_2$ left in U shaped cut out |
| 90 | User control buttons/switches |
| 67b | Spring mechanism |
| 82 | Pressure/force sensor |

BRIEF DESCRIPTION OF THE DRAWINGS

FIG. 3 shows orthogonally configured moveable saw blade sets according to one embodiment of the present invention.

FIG. 4 shows blown up picture of the box region shown by bold arrow (←)

in FIG. 3.

FIG. 5 shows top view of FIG. 3.

FIG. 6 shows moveable parallel blade sets 51, and 52 configured orthogonally in a plane. The supporting side frames are not shown)

FIG. 7 shows blown up picture of the box region shown by bold arrow (←)

in FIG. 6.

FIG. 8 shows side view of moveable parallel saw blade sets 51, and 52 configured orthogonally in a plane, supporting side frames are not shown)

FIG. 9 shows isometric view of the blade sets 51, and 52 wherein the blade sets 51, and 52 are vertically separated apart.

FIG. 10 shows different isometric view of the blade sets 51, and 52 wherein the blade sets 51, and 52 are vertically separated apart.

FIG. 11. shows anther different isometric view (front bottom right view) with the blade sets vertically separated apart for the purpose of teaching. The figure shows how the cut outs in the blades allow for the arrangement of the blades in orthogonal configuration.

FIG. 12 shows front view with the blade sets vertically separated apart.

FIG. 13 shows blade sets 53, and 54 without saw at the cutting edge, configured orthogonally in a plane, supporting sides have been removed.

FIG. 14 shows side view of orthogonally configured blade sets 53 or 54 without the saw at the cutting edge.

FIG. 15 shows different components of the system and their connection.

FIG. 16 shows side view of the system showing different components.

FIG. 17 shows top view showing different components of the system according to an embodiment of the system. The sensor is not shown.

FIG. 18 shows top view showing different components of the system according to a different embodiment of the system. The sensor is not shown.

FIG. 19*a* shows the side view of one embodiment of blade. The saw at the top of the blade is not shown.

FIG. 19*b* shows side view of one embodiment of another blade. The saw at the top of the blade is not shown.

FIG. 19*c* shows cross section through a blade along its axis when the blade sets are orthogonally configured. The saw at the top of the blade is not shown.

FIG. 20 showing blown up picture of the circle region of FIG. 19*c*. This picture shows allowable amplitude of oscillation of the blade sets.

FIG. 21 shows several steps describing how the device works.

FIG. 22 shows schematic of the smart food chopper according to an embodiment of the invention.

FIG. 23A shows the location of spring and sensor mechanism. The sensor and spring mechanism are located at the four corner of the lid and at the center as indicated by circles.

FIG. 23B shows the cross-section along the line AA' of FIG. 23A

DETAILED DESCRIPTION OF THE DIFFERENT EMBODIMENTS OF THE INVENTIONS

Figure 1:
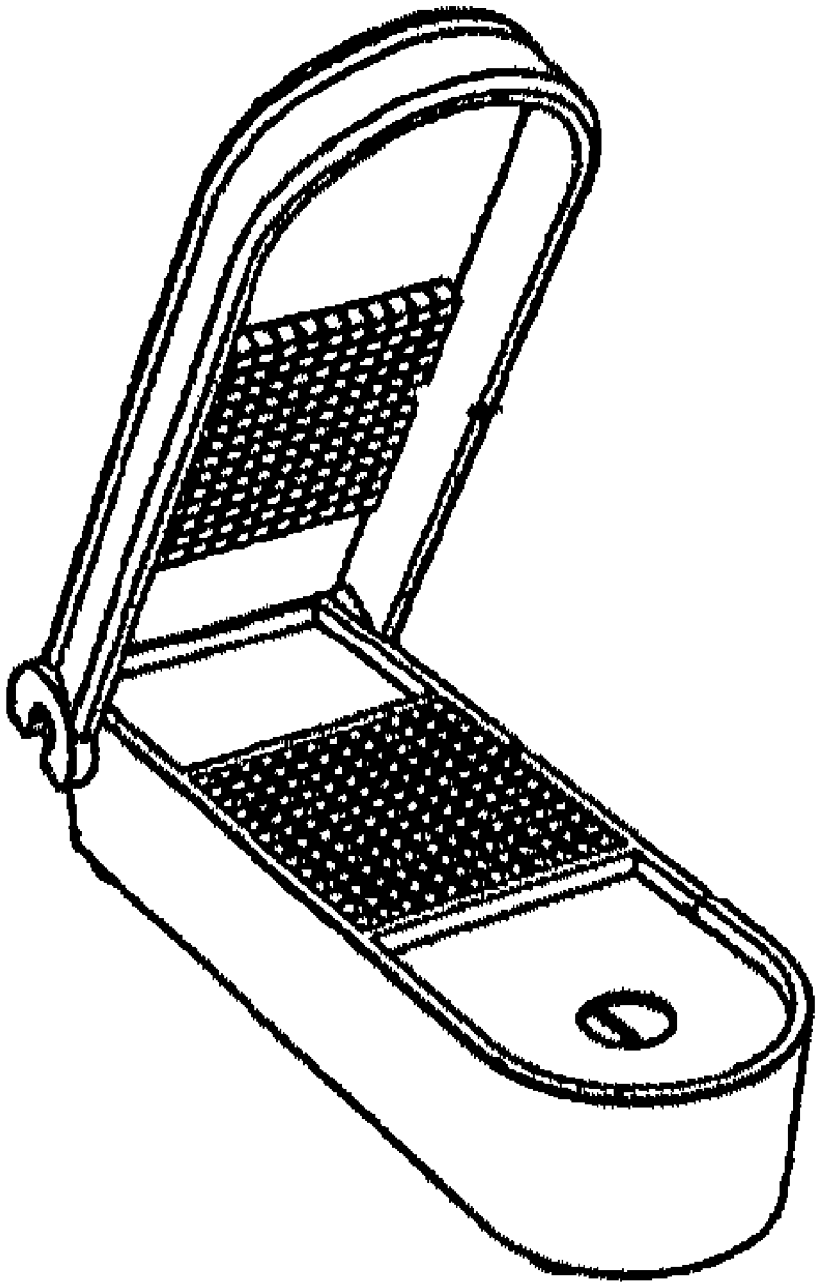
Figure 1 (prior art)
FIG. 1 is a perspective view of a food chopper of the prior art.
Figure 2:
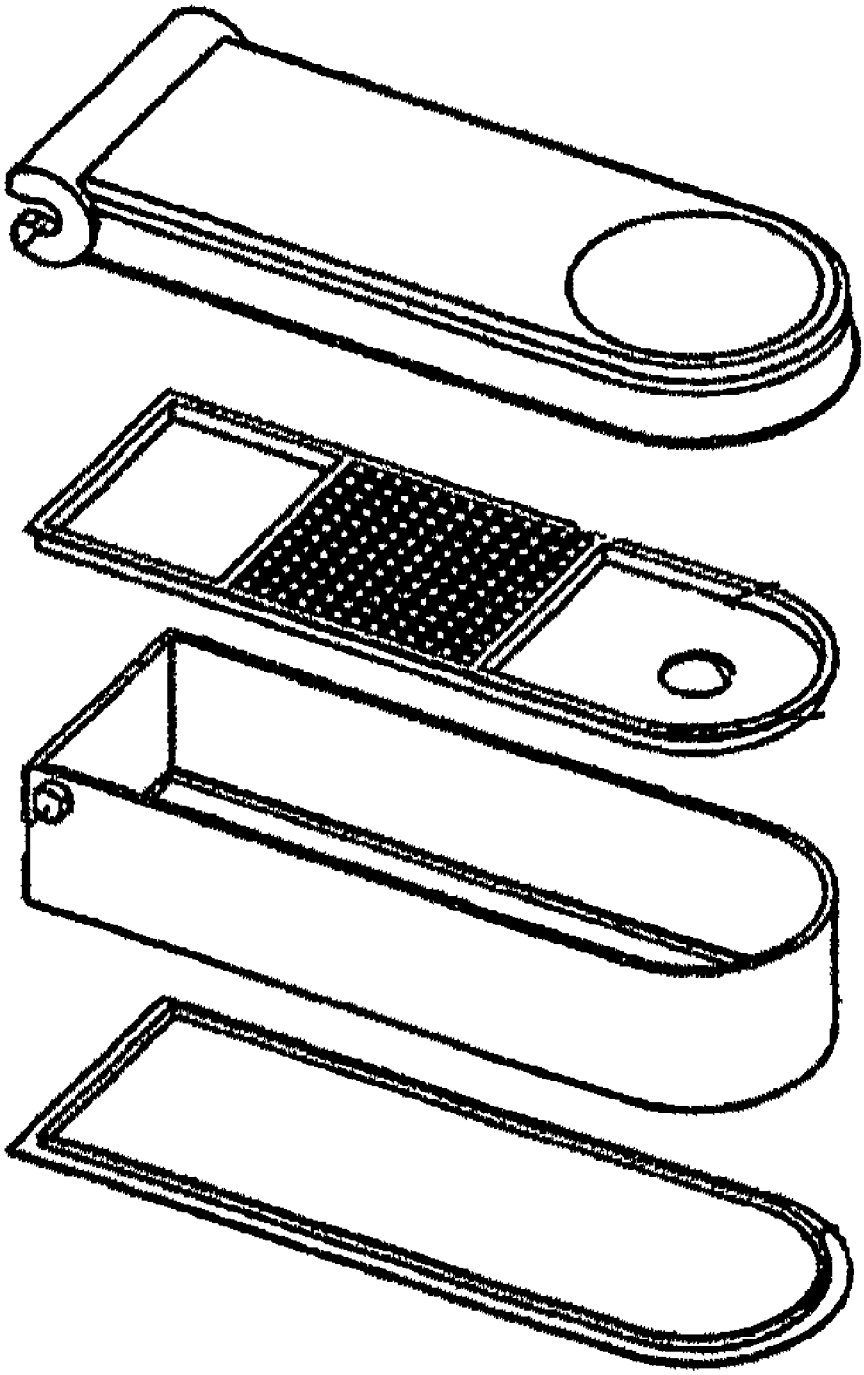
Figure 2 (Prior art)
FIG. 2 is an exploded view of the food chopper of prior art.

FIGS. 1 and 2 show the various embodiments of the prior art (U.S. 2007/0125217 A1). Blade 40 of the prior art is immovable. The prior art device require high pressure to onset the cutting process and chop off the food and vegetables. Use of such devices result in squashing of the food and vegetables. In some cases, the solid and liquid part of the vegetables may also be separated. The use of such devices may change the overall integrity of the food and vegetables. Prior art provide no means to overcome this problem.

FIGS. 3-21 illustrate a noble system and method of chopping foods and vegetables according to an embodiment of the present invention by providing blade sets that are moveable and are orthogonally configured. Each blade sets include parallel blades that are supported by a frame on opposing sides (FIG. 3). Each blade are equally spaced and are parallel with one another (FIGS. 4-13). Each blade have rectangular or U-shaped cut outs that are periodic along the length of the blade (see blades 51 and 52 in FIGS. 19*a*-19*c*, and FIGS. 4-11).

FIGS. 10 and 11 show blade sets 51 and 52 vertically separated apart for the purpose of teaching. The periodic, U shaped cut outs in the blades allow for the blade sets to be configured orthogonally as shown in FIGS. 3, 4, 6, 7, 13. When both the blade sets are snap fitted into the moving part of the linear rail [61-66], the bottom of U cut of one blade set comes close to the bottom of U cut of another blade set. This allows for the cutting edges/saw of both the blade sets to remain in the same plane substantially. In an embodiment, both the blade sets are substantially orthogonally configured. In operation, one blade set is snap fitted into the moveable part of the linear rail, and another blade set is snap fitted into the rail such that the U shaped cut outs of one blade face the U shaped cut outs of the another set of blades, and both the sets are orthogonally configured.

In a preferred embodiment, the depth and width of the cut outs are chosen such that one set can be put over the other set in orthogonal configuration (FIGS. 3, 4, 6, 7) and cutting edge of both the blade sets substantially remain in the same plane.

In another preferred embodiment, the depth of the cut is slightly higher than the half of the width of the blade. In operation, such cuts allow for the blades to have linear reciprocal oscillation without touching each other. Different depths of the cut outs can also be chosen based on needs. The width of the cut out can be changed to provide various amplitude of linear reciprocal oscillation of the blade sets.

FIG. 20 shows a blown up picture of the circle region of FIG. 19*c*. This picture illustrates allowable amplitude of oscillation of the blade sets. The width of the cut out g, and the thickness of the orthogonal blade t, determine the maximum amplitude of the blade set during its linear reciprocal oscillation/motion. The allowable amplitudes [a] of the oscillation pattern of the blade are given by the inequality, $a<=g-t$. In other words, the blade sets can be oscillated in any amplitude between 0 and $g-t$. If the thickness of the bladed set is 5 mm and width of the gap is 2 cm, the amplitude of the oscillation is constrained within the 1.5 cm. This means a user will be able to set the amplitude of the oscillation of the blade set anywhere between 0 and 1.5 cm. Various amplitude can be set by the user by means of a setting provided in the device.

FIG. 16 show side view of the device showing different components of the system. The blade sets 51 and 52 are removeably mounted into the moveable part (41-46) of linear rail (61-66). In an embodiment (FIG. 18), two linear rails 61, and 62 are mounted on one side of the blade set and a single rail 63 is mounted on the opposing side. One side of the moveable part of the linear rail 63 is connected to a cam follower 71 which is connected to an eccentric cam 72. The eccentric cam is coupled to an electric motor 73. The electric motor 73 is controlled by a controller 81. The rotational speed of the motor is controlled by pulse width modulation signal (PWM) sent from the controller. A sensor 82 is mounted underneath the linear rail 63 (FIG. 17). The pressure/force exerted onto the blades is measured by the sensor 82. The sensor 82 is arranged to send the force signal to the controller. A user control setting 90 is placed on external side of the device. A lid is hingedly connected to one end of the device such that it can be moved along an arch toward the removeable blade sets that are snap fitted to the moveable part of the linear rail. The electrical and mechanical communication of the different parts of the device is shown in FIG. 15.

Now the operation of the device is described in according to one embodiment of the device (FIG. 21). The user is allowed to set the linear oscillation pattern of the blade sets if he wishes to do so by means of user control setting (FIG. 16) before powering on the device. Once the user selects the oscillation pattern, he or she puts the food or vegetable needed to be chopped on the moveable blade sets 51, 52. Once the food is put on the surface, the user pushes the lid down toward the blade set to press the food through the grid. If the user has selected a particular oscillation setting (oscillation pattern), the controller automatically selects a particular pulse width modulation (PWM) value from the look up table according to the user selection, and sends the PWM signal to the motor. The motor starts to oscillate according the user selected oscillation pattern and the foods is chopped and is passed through the opening of the grid. The food is collected into a slidable container underneath the blade sets.

In another preferred embodiment, after powering on, if the user has not selected any oscillation pattern, the controller gets a pressure/force signal from the sensor which is described below. As the user presses the lid toward the blade set to push the food through the blade sets, the force of the user is coupled to the linear rail and to the sensor which send the signal to the controller. The controller selects a particular pulse width modulation (PWM) value from the look up table according to the pressure sensor signal from the sensor 82. As the food or vegetables is placed on the blades sets and is pressed by the lid, the pressure exerted by the vegetable on the blade sets is transformed onto the sensor 82 via linear rail. If the food or vegetable is much harder/stiffer, and is not chopped easily at the beginning or at any time during the process, and user attempts to chop the food by pressing the lid with a higher force, the sensor automatically detects the higher force/pressure signal and transmits the signal to the controller. The controller then selects another PWM signal from the look up table corresponding to new pressure value. In this way the oscillation frequency of the blade sets are automatically changed if more harder/stiffer food is needed to be processed. The present device automatically detects the need of higher oscillations for the food to be chopped based on user response during the use of the device. In other words, the device can dynamically change the oscillation pattern of the device according to the user response (such as user changing his pressure on the lid) during the chopping process. This process makes the food chopping process lot faster and easier without damaging the integrity of the food.

In another embodiment, the linear rails are supported by spring mechanism so that steady force is exerted on the food during the reciprocating action of the blade set. Spring mechanism also helps sensor for the smooth measurement of the pressure/force exerted on the blade sets.

In another embodiment, only one blade set is used for food cutting or chopping process to obtain the slices of the food.

In another embodiment of the device a voltage sensor is connected across the electric motor (see FIG. 15). During the chopping process, the voltage signal is sent to the controller constantly. If the voltage signal is larger than a predetermined value, the controller stops the current passing through the motor to shut down the motor so that the safety of the device as well as the user is maintained.

In this invention, the blade includes blades having cutting edge with or without saw. The term U or rectangular shaped cut outs implies the region where U or rectangular shaped region of the blade has been removed by cutting or by any other means.

What is claimed is:

1. A food processing device, comprising:

a lid, a first blade set, a second blade set, a first means configured to provide a lateral reciprocal motion to the first blade set, a second means configured to provide a lateral reciprocal motion to the second blade set, wherein the blade sets include an array of substantially parallel blades supported by two supporting frames from opposing sides, wherein all the blades of each blade set include uniform and periodic slots which extend along the transverse direction of the blade and open to the edge of the blade whereby the two blade sets can be configured in a grid or mesh like configuration when brought close to each other to be received in the slots, the lid is pivotally attached to the device for a movement between a first position relatively distant from the blade sets and a second position adjacent to the blade sets, the lid having an array of projections sized and configured to be accommodated between the plurality of blades when the lid is adjacent to the blade sets, the first blade set and the second blade set are configured for the lateral reciprocal movement, the first blade set and second blade set are configured to form a grid or mesh like configuration, the first blade set and second blade set are configured such that the movement of the first blade set and the second blade set are independent, the first blade set is mounted to the first means that is configured to provide the lateral reciprocal motion to the first blade set, and the second blade set is mounted to the second means that is configured to provide the lateral reciprocal motion to the second blade set.

2. A food processing device as set forth in claim 1, wherein the said blade sets are coupled to the said means that is configured to provide the lateral reciprocal motion via a low friction guided linear rail.

3. A food processing device, comprising:

a lid, a first blade set, a second blade set, a first means configured to provide a lateral reciprocal motion to the first blade set, a second means configured to provide a lateral reciprocal motion to the second blade set, and a controller, wherein the blade sets include an array of substantially parallel blades supported by two supporting frames from opposing sides, wherein all the blades of each blade set include uniform and periodic slots which extend along the transverse direction of the blade and open to the edge of the blade whereby the two blade sets can be configured in a grid or mesh line configuration when brought close to each other to be received in the slots, the lid is pivotally attached to the device for a movement between a first position relatively distant from the blade sets and a second position adjacent to the blade sets, the lid having an array of projections sized and configured to be accommodated between the plurality of blades when the lid is adjacent to the blade sets, the first blade set and the second blade set are configured for the lateral reciprocal movement, the first blade set and the second blade set are configured to form the grid or mesh like configuration, the first blade set and the second blade set are configured such that the movements of the first blade set and the second blade set are independent, the first blade set is mounted to the first means that is configured to provide the lateral reciprocal motion to the first blade set, and the second blade set is mounted to the second means that is configured to provide the lateral reciprocal motion to the second blade set, and the controller is configured to control the lateral reciprocal motion of the blade sets.

4. A food processing device as set forth in claim 3, wherein the controller is configured to control the lateral reciprocal motion of said blade sets by switching the reciprocal motion pattern of the blade sets according to a user selected setting.

5. A food processing device as set forth in claim 3, wherein the said blade sets are removeably mounted to the said means that is configured to provide the lateral reciprocal motion to the blade sets.

6. A food processing device as set forth in claim 3, wherein the said blade sets are removely mounted to the said means that is configured to provide the lateral reciprocal motion via a low friction guided linear rail.

7. A food processing device, comprising:

a lid, a first blade set, a second blade set, a receptacle for collecting processed food, a first means configured to provide a lateral reciprocal motion to the first blade set, a second means configured to provide a lateral reciprocal motion to the second blade set, a first low friction guided linear rail, a second low friction guided linear rail, at least a sensor and a controller, wherein the blade sets include an array of substantially parallel blades supported by two supporting frames from opposing sides, wherein all the blades of each blade set include uniform and periodic slots which extend along the transverse direction of the blade and open to the edge of the blade whereby the two blade sets can be configured in a grid or mesh line configuration when brought close to each other to be received in the slots, the lid is pivotally attached to the device for a movement between a first position relatively distant from the blade sets and a second position adjacent to the blade sets, the lid having an array of projections sized and configured to be accommodated between the plurality of blades when the lid is adjacent the blade sets, the first blade set and the second blade set are configured for the lateral reciprocal movement, the first blade set and the second blade set are configured to form the grid or mesh like configuration, the first blade set and the second blade set are configured such that the movements of the first blade set and the second blade set are independent, the first blade set is removeably mounted to the first means that is configured to provide the lateral reciprocal motion to the first blade set via the first low friction guided linear rail, the second blade set is removeably mounted to the second means that is configured to provide the lateral reciprocal motion to the second blade set via the second low friction guided linear rail, at least a sensor is configured to detect the pressure exerted on the said blade sets and provide the pressure information to the controller the controller is configured to control the lateral reciprocal motion or oscillation pattern of the blade sets.

8. A food processing device as set forth in claim 7, wherein the controller is configured to automatically control the lateral reciprocal motion or oscillation pattern of the blade sets according to the pressure information received from the sensors.

9. A food processing device as set forth in claim 7, wherein the controller controls the lateral reciprocal motion or oscillation pattern of the blade sets by first receiving a lateral reciprocal motion or oscillation pattern signal from a first look up table corresponding to the pressure signal received from the pressure sensor, and then by setting the oscillation pattern of the blade sets to a lateral reciprocal motion or oscillation pattern corresponding to the pressure signal received from the pressure sensor, and wherein the look up table stores predetermined motion or oscillation pattern signals corresponding to the various pressure information received from the pressure sensors.

10. A food processing device as set forth in claim 7, wherein the controller controls the lateral reciprocal motion or oscillation pattern of the blade sets by obtaining oscillation pattern signal from a second look up table that has stored predetermined lateral reciprocal motion or oscillation pattern signals corresponding a user selection, and by setting the lateral reciprocal motion or oscillation pattern of the blade sets according to that predetermined signal.

11. A food processing device as set forth in claim 7, wherein said pressure sensors are mounted on the lower side of the low friction guided linear rail.

12. A food processing device as set forth in claim 7, wherein said sensors are mounted on the lower side of the low friction guided linear rail via a spring mechanism.

13. A food processing device as set forth in claim 7, wherein said sensor are mounted on the lid via spring mechanism.

14. A food processing device as set forth in claim 7, wherein said sensors are selected from the group consisting of piezoelectric pressure sensor, capacitive pressure sensor, quartz pressure sensor, and ferroelectric pressure sensor.

15. A food processing device as set forth in claim 7, wherein the lid, the first blade set, the second blade set, the receptacle, the first means configured to provide a lateral reciprocal motion to the first blades, the second means configured to provide a lateral reciprocal motion to the second blades, the low friction guided linear rail, the sensors and the controllers are housed in a housing to form a small type food processor.

16. A food processing device as set forth in claim 7, wherein the lid is removably mounted to the device.

17. A food processing device as set forth in claim 8, wherein the lateral reciprocal motion or oscillation patterns of the blade sets is characterized by the amplitude of the oscillation/motion of the blade sets.

18. A food processing device as set forth in claim 8, wherein the lateral reciprocal motion or oscillation pattern of the blade sets is characterized by the frequency of the oscillation/motion of the blade sets.

19. A food processing device as set forth in claim 7, wherein the amplitude of oscillation/motion of the blade sets is characterized by the inequality $0 < a < g-t$, wherein a is the amplitude of the oscillation/motion, g is the width of the slot and t is the thickness of the oscillating blades.

20. A food processing device as set forth in claim 15, wherein the receptacle is removely accommodated in the housing.

21. A food processing device as set forth in claim 9, wherein the lateral reciprocal motion or oscillation patterns of the blade sets is characterized by the amplitude of the oscillation/motion of the blade sets.

22. A food processing device as set forth in claim 9, wherein the lateral reciprocal motion or oscillation pattern of the blade sets is characterized by the frequency of the oscillation/motion of the blade sets.

23. A food processing device as set forth in claim 10, wherein the lateral reciprocal motion or oscillation patterns of the blade sets is characterized by the amplitude of the oscillation/motion of the blade sets.

24. A food processing device as set forth in claim 10, wherein the lateral reciprocal motion or oscillation pattern of the blade sets is characterized by the frequency of the oscillation/motion of the blade sets.

25. A food processing device, comprising:

a lid, a first blade set, a second blade set, a receptacle for collecting processed food, a first means configured to provide a lateral reciprocal motion to the first blade set, a second means configured to provide a lateral reciprocal motion to the second blade set, a first low friction guided linear rail, a second low friction guided linear rail, at least a sensor and a controller, wherein the blade sets include an array of substantially parallel blades supported by two supporting frames from opposing sides, wherein the blades of one blade set include uniform and periodic slots which extend along the transverse direction of the blade and open to the edge of the blade whereby the plane of the cutting edges of the two blade sets substantially lie in the same planes when the two blade sets are brought close to each other to be received in the slots and the two blade form a grid or mesh line configuration, the lid is pivotally attached to the device for a movement between a first position relatively distant from the blade sets and a second position adjacent to the blade sets, the lid having an array of projections sized and configured to be accommodated between the plurality of blades when the lid is adjacent the blade sets, the first blade set and the second blade set are configured for the lateral reciprocal movement, the first blade set and the second blade set are configured to form the grid or mesh like configuration, the first blade set and the second blade set are configured such that the movements of the first blade set and the second blade set are independent, the first blade set is removeably mounted to the first means that is configured to provide the lateral reciprocal motion to the first blade set via the first low friction guided linear rail, the second blade set is removeably mounted to the second means that is configured to provide the lateral reciprocal motion to the second blade set via the second low friction guided linear rail, at least a sensor is configured to detect the pressure exerted on the said blade sets and provide the pressure information to the controller the controller is configured to control the lateral reciprocal motion or oscillation pattern of the blade sets according to the pressure information.

* * * * *